United States Patent [19]

Eilers et al.

[11] Patent Number: 4,460,456

[45] Date of Patent: Jul. 17, 1984

[54] PROCESS FOR REDUCING RAMSBOTTOM CARBON TEST OF LONG RESIDUES

[75] Inventors: Jacobus Eilers; Willem H. J. Stork, both of Amsterdam, Netherlands

[73] Assignee: Shell Oil Company, Houston, Tex.

[21] Appl. No.: 388,776

[22] Filed: Jun. 15, 1982

[30] Foreign Application Priority Data

Jun. 29, 1981 [NL] Netherlands ..... 8103121

[51] Int. Cl.[3] ..... C10G 45/00; C10G 47/02; C10G 47/04; C10C 3/08

[52] U.S. Cl. ..... 208/89; 208/40; 208/112; 208/143; 208/309

[58] Field of Search ..... 208/143, 112, 89, 40, 208/309

[56] References Cited

U.S. PATENT DOCUMENTS

| | | | |
|---|---|---|---|
| 2,975,121 | 3/1961 | Whaley | 208/251 |
| 3,362,901 | 1/1968 | Szepe et al. | 208/309 |
| 3,368,965 | 2/1968 | Schuman | 208/112 |
| 3,617,503 | 11/1971 | Rogers et al. | 208/112 |
| 3,723,297 | 3/1973 | Gatsis et al. | 208/309 |
| 3,796,653 | 3/1974 | Gatsis et al. | 208/309 |
| 3,920,538 | 11/1975 | Pronk et al. | 208/89 |
| 3,948,756 | 4/1976 | Wolk et al. | 208/112 |
| 4,176,048 | 11/1979 | Corns et al. | 208/89 |
| 4,191,635 | 3/1980 | Quick et al. | 208/89 |
| 4,358,365 | 11/1982 | Hutchings et al. | 208/309 |
| 4,396,493 | 8/1983 | Eilers et al. | 208/111 |
| 4,396,494 | 8/1983 | Eilers et al. | 208/96 |
| 4,397,773 | 8/1983 | Eilers et al. | 208/96 |

FOREIGN PATENT DOCUMENTS

| | | | |
|---|---|---|---|
| 1586900 | 3/1970 | France | 208/89 |

*Primary Examiner*—Delbert E. Gantz
*Assistant Examiner*—Helane E. Maull
*Attorney, Agent, or Firm*—John M. Duncan

[57] ABSTRACT

Process for the preparation of a heavy oil with a low Ramsbottom Carbon Test (RCT) from a long residue by (a) catalytic hydrotreatment for RCT reduction at such severity that the $C_4^-$ gas production per percentage RCT reduction is kept between defined limits, followed by (b) solvent deasphalting of the (vacuum or atmospheric) distillation residue of the hydrotreated product.

9 Claims, No Drawings

PROCESS FOR REDUCING RAMSBOTTOM CARBON TEST OF LONG RESIDUES

BACKGROUND OF THE INVENTION

The invention relates to a process for the preparation of a hydrocarbon mixture having a Ramsbottom Carbon Test value (RCT) of (a) %w and an initial boiling point of T°C.

The RCT is an important parameter in the assessment of the suitability of heavy hydrocarbon oils as feedstocks for catalytic conversion processes, such as catalytic cracking, carried out in the presence or absence of hydrogen, for the preparation of light hydrocarbon distillates, such as gasoline and kerosine. According as the feed has a higher RCT, the catalyst will be deactivated more rapidly in these processes.

Atmospheric residues obtained in the distillation of a crude mineral oil generally have too high an RCT to be suitable without previous treatment for use as feeds for the afore-mentioned catalytic conversion processes. Since the RCT of residual hydrocarbon oils is mainly determined by the proportion of asphaltenes present in the oils, a reduction of the RCT of these oils can be obtained by reducing the asphaltenes content. Basically, this may be achieved in two ways. Part of the asphaltenes may be separated from the oil by solvent deasphalting, or part of the asphaltenes may be converted by subjecting the oil to a catalytic hydrotreatment. For the reduction of the RCT of heavy hydrocarbon oils the latter method is preferred, in the first place, because its yield of heavy product with a low RCT is higher and further because, in contrast to the former method, where asphaltic bitumen is obtained as a by-product, it yields a valuable $C_5+$ atmospheric distillate as a by-product. A drawback to the latter method, however, is that it gives rise to the formation of an undesirable $C_4-$ fraction which, moreover, contributes considerably to the hydrogen consumption of the process.

Applicants have carried out an investigation into the reduction of the RCT through catalytic hydrotreatment of atmospheric residues obtained in the distillation of crude mineral oils. This investigation has shown that, according as the catalytic hydrotreatment is carried out under more severe conditions in order to attain a greater RCT reduction, the parameter "$C_4-$ production per % RCT reduction" (for the sake of brevity hereinafter referred to as "G") at first remains virtually constant ($G_c$) and subsequently shows a fairly sharp increase. In view of the hydrogen consumption of the process it is important to take care that the RCT reduction is not carried beyond the value corresponding with $G=2\times G_c$. This means that in practice there will be a number of cases in which it is undesirable, starting from a atmospheric residue obtained in the distillation of a crude mineral oil (for the sake of brevity hereinafter referred to as "atmospheric residue I"), to employ nothing but a catalytic hydrotreatment for the preparation of a product from which, after separation of an atmospheric distillate, an oil having an initial boiling point of T°C. and an RCT of (a) %w can be obtained. In those cases there is nevertheless an attractive manner of preparing from a atmospheric residue I an oil having the afore-mentioned initial boiling point and RCT. To this end the product obtained in the catalytic hydrotreatment is separated by distillation into an atmospheric distillate and an atmospheric residue (for the sake of brevity hereinafter referred to as "atmospheric residue II") having an initial boiling point of T°C. The process may be continued in two ways. First, from atmospheric residue II so much asphaltic bitumen may be separated by solvent deasphalting that a deasphalted atmospheric residue having the desired RCT of (a) %w is obtained. Secondly, atmospheric residue II may be separated by distillation into a vacuum distillate and a vacuum residue and from the vacuum residue so much asphaltic bitumen may be separated by solvent deasphalting that a deasphalted vacuum residue is obtained having an RCT which is such that when this deasphalted vacuum residue is mixed with the previously separated vacuum distillate, an oil is obtained which has the desired RCT of (a) %w. The most attractive balance between yields of: $C_4-$ fraction, $C_5+$ atmospheric distillate, asphaltic bitumen and oil having an initial boiling point of T°C. and an RCT of (a) %w is obtained when the catalytic hydrotreatment is carried out under such conditions that G lies between $1.5\times G_c$ and $2.0\times G_c$. When the catalytic hydrotreatment is carried out under such conditions that $G<1.5\times G_c$, $C_4-$ production is still low, but the yield of oil having an initial boiling point of T°C. and an RCT of (a) %w in the combination process is unsatisfactory. When the catalytic hydrotreatment is carried out under such conditions that $G>2.0\times G_c$, a high yield of oil having an initial boiling point of T°C. and an RCT of (a) %w in the combination process is still obtained, but is attended with unacceptably high $C_4-$ production.

Applicants have found that the RCT reductions in the catalytic hydrotreatment, in which for G values are reached which correspond with $1.5\times G_c$ and $2.0\times G_c$, are dependent on T, the RCT of atmospheric residue I (b %w) and the percentage by weight of atmospheric residue I which boils below 520° C. (d %w), and are expressed by a numerical relation.

SUMMARY OF THE INVENTION

A process is disclosed for the preparation of a hydrocarbon mixture having an RCT of (a) %w and an initial boiling point of T°C., wherein an atmospheric residue I obtained in the distillation of a crude mineral oil, which atmospheric residue has an RCT of (b) %w and (d) %w of which boils below 520° C., is subjected to a catalytic hydrotreatment in order to reduce the RCT; the product obtained is separated by distillation into an atmospheric distillate and an atmospheric residue II having an initial boiling point of T°C.; either so much asphaltic bitumen is separated from the atmospheric residue II by solvent deasphalting that a deasphalted atmospheric residue having the desired RCT of (a) %w is obtained, or the atmospheric residue II is separated by distillation into a vacuum distillate and a vacuum residue, from which vacuum residue so much asphaltic bitumen is separated by solvent deasphalting that a deasphalted vacuum residue is obtained which has such an RCT that, when it is mixed with the vacuum distillate, a mixture having the desired RCT of (a) %w is obtained; and the catalytic hydrotreatment is carried out under such conditions as to obey the relation:

$$RCT\ \text{reduction} = \frac{b-c}{b}\times 100 = \frac{51.6-0.526\times d-0.115-T+2.55\times b+0.00115\times T\times d}{(1.426-1.15\times 10^{-3}\times T)(1-0.01\times d)} \pm 5,$$

where (c) is the RCT of the atmospheric residue II having an initial boiling point T°C. of the hydrotreated product.

DESCRIPTION OF PREFERRED EMBODIMENTS

The relation found by the Applicants in the first place offers an opportunity of determining whether, in view of the maximum acceptable value of G (corresponding with $2.0 \times G_c$), it is possible by catalytic hydrotreatment alone, starting from an atmospheric residue I a given percentage of (d) %w of which boils below 520° C. and which has a given RCT of (b) %w, to prepare a product from which, by distillation, an atmospheric residue can be obtained which has a given initial boiling point of T°C. and a given RCT of (a) %w. If, according to the relation, this proves impossible and, therefore, the combination route has to be applied, the relation further indicates the limits between which, in the catalytic hydrotreatment of the combination route, the RCT reduction should be chosen in order to ensure optimum efficiency of the combination route.

The present patent application therefore relates to a process for the preparation of a hydrocarbon mixture with an RCT of (a) %w and an initial boiling point of T°C., in which an atmospheric residue I which has an RCT of (b) %w and (d) %w of which boils below 520° C., is subjected to a catalytic hydrotreatment in order to reduce its RCT, in which the product obtained is separated by distillation into an atmospheric distillate and an atmospheric residue II having an initial boiling point of T°C., in which either so much asphaltic bitumen is separated from atmospheric residue II by solvent deasphalting that a deasphalted atmospheric residue having the desired RCT of (a) %w is obtained, or atmospheric residue II is separated by distillation into a vacuum distillate and a vacuum residue from which vacuum residue so much asphaltic bitumen is separated by solvent deasphalting that a deasphalted vacuum residue is obtained which has such an RCT that, when it is mixed with the vacuum distillate, a mixture having the desired RCT of (a) %w is obtained, and in which the catalytic hydrotreatment is carried out under such conditions that the afore-mentioned relation is satisfied.

In the process according to the invention the RCT (b) of the atmospheric residue (I) used as feed, the RCT (a) of the hydrocarbon mixture to be prepared, and the RCT (c) of the atmospheric residue II with an initial boiling point of T°C. of the hydrotreated product, should be known. When the hydrocarbon mixture to be prepared is a mixture of a vacuum distillate and a deasphalted vacuum residue, the RCT's of the two components of the mixture and the RCT of the vacuum residue (II) that was deasphalted, should be known as well. As regards the way in which the RCT's of the various hydrocarbon mixtures are determined, the following three cases may be distinguished.

(a) The viscosity of the hydrocarbon mixture to be investigated is so high that it is impossible to determine the RCT by ASTM method D 524. In this case, the CCT (Conradson Carbon Test value) of the mixture is determined by ASTM method D 189, and the RCT is computed from the CCT according to the formula:

$$RCT = 0.649 \times (CCT)^{1.144}$$

(b) The viscosity of the hydrocarbon mixture to be investigated is such that the RCT can still be determined according to the ASTM D 524 method, but this method gives an RCT value which lies above 20.0 %w. In this case, as in the case mentioned under (a), the CCT of the mixture is determined by ASTM method D 189 and the RCT is computed from the CCT according to the formula mentioned under (a).

(c) The viscosity of the hydrocarbon mixture to be investigated is such that the RCT can be determined by ASTM method D 524 and this method gives an RCT value not higher than 20.0 %w. In this case the value thus found is taken to be the RCT of the mixture concerned.

In practice, for the determination of the RCT's of vacuum distillates, atmospheric residues, deasphalted distillation residues and mixtures of vacuum distillates and deasphalted distillation residues the direct method described under (c) will in many cases be sufficient. In the determination of the RCT of vacuum residues both the direct method described under (c) and the indirect method described under (b) are used. In the determination of the RCT of asphaltic bitumens the indirect method described under (a) is usually the only one eligible.

The process according to the invention is a two-step process in which reduction of the RCT is attained through reduction of the asphaltenes content. In the first step of the process the asphaltenes content is reduced by converting part of the asphaltenes by means of a catalytic hydrotreatment. In the second step of the process the asphaltenes content is reduced by separating part of the asphaltenes by means of solvent deasphalting.

Atmospheric residues obtained in the distillation of a crude mineral oil usually contain an appreciable percentage of metals, especially vanadium and nickel. When such atmospheric residues are subjected to a catalytic treatment, e.g., a catalytic hydrotreatment for RCT reduction, as in the process according to the invention, these metals will be deposited on the RCT-reduction catalyst, thus shortening its life. In view of this, atmospheric residues having a vanadium+nickel content of more than 50 ppmw should preferably be subjected to demetallization before being contacted with the RCT-reduction catalyst. This demetallization may very suitably be carried out by contacting the atmospheric residue, in the presence of hydrogen, with a catalyst consisting more than 80 %w of silica. Both catalysts consisting entirely of silica and catalysts containing one or more metals having hydrogenating activity, in particular a combination of nickel and vanadium, on a carrier substantially consisting of silica, are eligible for the purpose. Very suitable demetallization catalysts are those which meet certain given requirements as regards their porosity and particle size and which are described in Netherlands patent application No. 7,309,387. When in the process according to the invention a catalytic demetallization in the presence of hydrogen is applied to atmospheric residue I, this demetallization may be carried out in a separate reactor. Since the catalytic demetallization and the catalytic RCT reduction can be carried out under the same conditions, both processes may very suitably be carried out in the same reactor containing, successively, a bed of demetallization catalyst and a bed of RCT-reduction catalyst.

It should be noted that in the catalytic demetallization the reduction of the metal content is accompanied by some reduction of the RCT. The same applies to the catalytic RCT reduction in which the RCT reduction is accompanied by some reduction of the metal content. For application of the relation upon which the present invention is based, RCT reduction should be taken to be the total RCT reduction occurring in the catalytic hydrotreatment (i.e., including that occurring in a possible catalytic demetallization process).

Suitable catalysts for carrying out the catalytic RCT reduction are those which contain at least one metal chosen from the group formed by nickel and cobalt and, in addition, at least one metal chosen from the group formed by molybdenum and tungsten on a carrier, which carrier consists more than 40 %w of alumina. Very suitable RCT-reduction catalysts are those which comprise the metal combination nickel/molybdenum or cobalt/molybdenum on alumina as the carrier.

The catalytic RCT reduction is preferably carried out at a temperature of 300°-500° C., a pressure of 50-300 bar, a space velocity of 0.02-10 $g.g^{-1}.h^{-1}$ and a $H_2$/feed ratio of 100-5000 Nl/kg. Particular preference is given to carrying out the catalytic RCT reduction at a temperature of 350°-450° C., a pressure of 75-200 bar, a space velocity of 0.1-2 $g.g^{-1}.h^{-1}$ and a $H_2$/feed ratio of 500-2000 Nl/kg. As regards the conditions to be used in a catalytic demetallization process in the presence of hydrogen, to be carried out if necessary, the same preference applies as that stated hereinbefore for the catalytic RCT reduction.

The desired RCT reduction in the first step of the process according to the invention may, for instance, be achieved by application of the space velocity (or temperature) pertaining to that RCT reduction, which can be read from a graph composed on the basis of a number of scouting experiments with atmospheric residue I carried out at different space velocities (or temperatures) and in which the RCT reductions achieved have been plotted against the space velocities (or temperatures) used. Apart from the space velocity or temperature, which is variable, the other conditions in the scouting experiments are kept constant and chosen equal to those which will be used when the process according to the invention is applied in practice.

The second step of the process according to the invention is a solvent deasphalting step applied to a residue from the distillation of the hydrotreated product of the first step. The distillation residue to which the solvent deasphalting step is applied may be an atmospheric residue or a vacuum residue from the hydrotreated product. Preferably, a vacuum residue from the hydrotreated product is used for the purpose. Suitable solvents for carrying out the solvent deasphalting are paraffinic hydrocarbons having 3-6 carbon atoms per molecule, such as n-butane and mixtures thereof, such as mixtures of propane with n-butane and mixtures of n-butane with n-pentane. Suitable solvent/oil weight ratios lie between 7:1 and 1:1 and in particular between 4:1 and 2:1. The solvent deasphalting is preferably carried out at a pressure between 20 and 100 bar. When n-butane is used as the solvent, the deasphalting is preferably carried out at a pressure of 35-45 bar and a temperature of 100°-150° C.

When the RCT reduction in the second step of the process according to the invention takes place by solvent deasphalting of an atmospheric residue, the desired RCT of the deasphalted atmospheric residue may be attained, for instance, by using the deasphalting temperature pertaining to that RCT, which can be read from a graph composed on the basis of a number of scouting experiments with atmospheric residue II carried out at different temperatures, in which the RCT's of the deasphalted atmospheric residues obtained have been plotted against the temperatures applied. Apart from the temperature, which is variable, the other conditions in the scouting experiments are kept constant and chosen equal to those which will be used when the process according to the invention is applied in practice.

When the RCT reduction in the second step of the process according to the invention takes place by solvent deasphalting of a vacuum residue, after which the deasphalted vacuum residue is mixed with the vacuum distillate separated earlier, the RCT and the quantity of the deasphalted vacuum residue should be adjusted to the quantity and the RCT of the vacuum distillate as follows. When a given quantity of vacuum distillate (VD) of A pbw having a given $RCT_{VD}$ is available, then, in order to obtain a mixture M having a given $RCT_M$ by mixing the vacuum distillate with deasphalted vacuum residue (DVR), B pbw of deasphalted vacuum residue will have to be prepared, its $RCT_{DVR}$ being such that it obeys the relation:

$$\frac{A \times RCT_{VD} + B \times RCT_{DVR}}{A + B} = RCT_M$$

or, expressed otherwise, $$A(RCT_M - RCT_{VD}) = B(RCT_{DVR} - RCT_M).$$

In the equation mentioned hereinabove the left-hand member is known. In addition, in the right-hand member $RCT_M$ is known. On the basis of a number of scouting experiments carried out with vacuum residue at, for instance, different temperatures, a graph can be composed in which the term $B(RCT_{DVR} - RCT_M)$ has been plotted against the temperature used. The temperature to be applied in the deasphalting in the second step of the process according to the invention may be read from this graph, this being the temperature at which the term $B(RCT_{DVR-RCTM})$ has the given value $A(RCT_M - RCT_{VD})$. Apart from the temperature, which is variable, the other conditions in the scouting experiments on deasphalting are kept constant and chosen equal to those which will be applied when the process according to the invention is used in practice.

Besides the RCT, the metal content is also an important parameter in assessing the suitability of heavy hydrocarbon oils as feeds for catalytic conversion processes, in the presence or absence of hydrogen, for the preparation of light hydrocarbon distillates, such as gasoline and kerosine. According as the feed has a higher metal content, the catalyst will be deactivated more rapidly in these processes. As a rule, atmospheric residues obtained in the distillation of a crude mineral oil have not only too high an RCT, but also too high a metal content to be suitable, without treatment, as feeds for the afore-mentioned catalytic conversion processes. The product obtained in the process according to the invention is a deasphalted atmospheric residue or a mixture of a vacuum distillate and a deasphalted vacuum residue, which product, in addition to a low RCT, has a very low metal content. This is due to a considerable extent to the fact that the metal-containing distillation residue which is subjected to solvent deasphalting has been catalytically hydrotreated. For, the solvent deasphalting of such metal-containing residues shows a very high metal-removing selectivity.

The invention is now elucidated with the aid of the following example, which is intended to be a complete specific embodiment of the invention and is not intended to be regarded as a limitation thereof.

EXAMPLE

In the investigation two atmospheric residues were used which had been obtained in the distillation of crude mineral oils (Atmospheric residues A and B).

Atmospheric residue A had an RCT of 10 %w (determined by ASTM method D 524), a vanadium+nickel content of 70 ppmw and a percentage boiling below 520° C. of 50 %w.

Atmospheric residue B had an RCT of 15.6 %w (determined by ASTM method D 524), a vanadium+-nickel content of 500 ppmw and a percentage boiling below 520° C. of 29.4 %w.

As regards the question whether it is possible, in view of the maximum permissible value of G, starting from atmospheric residue A, to prepare by nothing but catalytic hydrotreatment of a product from which, by distillation, an atmospheric residue can be obtained which has an initial boiling point of 370° C. and an RCT lower than that of atmospheric residue A, application of the relation found, in the form $$\frac{b-c}{b} \times 100 = F_{max}$$

(where $F_{max}$ is the maximum value of the right-hand member of the relation), with substitution of b=10, T=370 and d-50, shows that this is quite feasible provided that the atmospheric residue with an initial boiling point of 370° C. to be prepared has an RCT (c) higher than 3.6 %w. This means, for instance, that, starting from atmospheric residue A, for the preparation of an atmospheric residue having an initial boiling point of 370° C. and an RCT (c) of 4.5 %w a catalytic hydrotreatment alone will be sufficient.

If, however, from atmospheric residue A an oil is to be prepared having an initial boiling point of 370° C. and an RCT of 1.5 %w a catalytic hydrotreatment alone is not sufficient in view of the maximum permissible value of G. Then, in addition to the catalytic hydrotreatment, a solvent deasphalting treatment should be applied. Application of the relation found, in the form:

maximum RCT reduction $=F_{max}$, and minimum RCT reduction $=F_{min}$ (where $F_{max}$ and $F_{min}$ are the maximum and the minimum value, respectively, of the right-hand member of the relation), with substitution of b=10, T=370 and d-50, shows that for optimum utilization of the combination process care should be taken that the RCT reduction in the catalytic hydrotreatment is between 54.1 and 64.1%.

With the object of preparing atmospheric residues having an initial boiling point of 370° C. and different RCT's (c), atmospheric residue A was subjected to catalytic hydrotreatment in thirteen experiments. The experiments were carried out in a 1000 ml reactor containing two fixed catalyst beds of a total volume of 600 ml. The first catalyst bed consisted of a $Ni/V/SiO_2$ catalyst containing 0.5 pbw of nickel and 2.0 pbw of vanadium per 100 pbw of silica. The second catalyst bed consisted of a $Co/Mo/Al_2O_3$ catalyst containing 4 pbw of cobalt and 12 pbw of molybdenum per 100 pbw of alumina. The weight ratio between the $Ni/V/SiO_2$ and $Co/Mo/Al_2O_3$ catalysts was 1:3. All the experiments were carried out at a temperature of 390° C., a pressure of 125 bar and a $H_2$/oil ratio of 1000 Nl/kg. Various space velocities were used in the experiments. The results of Experiments 1–12 are listed in Table A. The values given relate to observations carried out at run hour 450.

For each experiment the table gives the space velocity used, the RCT reduction $$\left(\frac{b-c}{b} \times 100\right)$$

achieved and the corresponding $C_4^-$ production (calculated as %w on feed). Experiments 1–12 were carried out in pairs, the difference in space velocity between the two experiments of each pair being such as to achieve a difference in RCT reduction of about 1.0%. The table further gives the $C_4^-$ production per % RCT reduction (G) for each pair of experiments.

TABLE A

| Experiment Number | Space velocity $g.g.^{-1}.h^{-1}$ | RCT reduction, % | $C_4^-$ production, % w | G, % w |
|---|---|---|---|---|
| 1 | 1.50 | 31.9 | 0.481 | |
| | | | | 0.015 |
| 2 | 1.40 | 32.9 | 0.496 | |
| 3 | 2.42 | 20.0 | 0.300 | |
| | | | | 0.015 |
| 4 | 2.31 | 21.3 | 0.319 | |
| 5 | 1.07 | 40.2 | 0.603 | |
| | | | | 0.016 |
| 6 | 1.03 | 41.1 | 0.617 | |
| 7 | 0.61 | 53.5 | 0.901 | |
| | | | | 0.023 |
| 8 | 0.57 | 54.7 | 0.929 | |
| 9 | 0.40 | 63.4 | 1.164 | |
| | | | | 0.030 |
| 10 | 0.37 | 64.6 | 1.200 | |
| 11 | 0.30 | 70.0 | 1.432 | |
| | | | | 0.057 |
| 12 | 0.27 | 71.1 | 1.495 | |

Experiment 13 was carried out at a space velocity of 0.50 $g.g^{-1}.h^{-1}$. The RCT reduction was 59% and the $C_4^-$ production 1.03 %w.

Of Experiments 1–13 only Experiments 8, 9 and 13 are experiments according to the invention. The other experiments fall outside the scope of the invention. They have been included in the patent application for comparison. As can be seen in Table A, in Experiments 1–2, 3–4 and 5–6, in which RCT reductions were acheived of about 30, 20 and 40%, respectively, G remains virtually constant ($G_c$). In Experiments 7–8 and 9–10, in which RCT reductions were achieved of about 54 and 64%, respectively, G was about $1.5 \times G_c$ and $2.0 \times G_c$, respectively. In Experiments 11–12, in which RCT reductions were achieved of about 70%, G was larger than $3 \times G_c$.

Comparison of Experiments 5 and 11 shows that reduction of the space velocity from 1.07 to 0.30 $g.g^{-1}.h^{-1}$ at a constant temperature of 390° C., results in an increase in RCT reduction from 40 to 70% and an increase in $C_4^-$ production from 0.603 to 1.432 %w. For comparison with Experiment 5, Experiment 14 was carried out, in which an increase in RCT reduction from 40 to 70% was realized by an increase in temperature from 390° to 414° C. at a constant space velocity of 1.07 $g.g^{-1}.h^{-1}$. In Experiment 14 the $C_4-$ production was 1.82 %w (instead of 1.43 %w, as in Experiment 11).

In three experiments (Experiments 15, 16 and 17, respectively) the products obtained in the catalytic hydrotreatment carried out according to Experiments 5, 11 and 13 were separated by successive atmospheric distillation and vacuum distillation into a $C_4-$ fraction, a $H_2S+NH_3$ fraction, a $C_5$–370° C. atmospheric distillate, a 370°–520° C. vacuum distillate and a 520° C.+ vacuum residue. The vacuum residues were deasphalted with n-butane at a pressure of 40 bar and a solvent/oil weight ratio of 3:1, and the deasphalted vacuum residues obtained were mixed with the corresponding vacuum distillates. The results of these experiments (of which only Experiment 17 is an experiment according to the invention) are listed in Table B.

TABLE B

| Experiment Number | 15 | 16 | 17 |
|---|---|---|---|
| $H_2$-treated product from Experiment Number | 5 | 11 | 13 |
| Distillation | | | |
| Yield of products calculated on 100 pbw atmospheric residue I, pbw | | | |
| $C_4-$ | 0.60 | 1.43 | 1.03 |
| $H_2S + NH_3$ | 2.9 | 3.4 | 3.2 |
| $C_5$ –370° C. | 8.2 | 11.7 | 10.5 |
| 370–520° C. (vacuum distillate) | 56.3 | 58.0 | 58.1 |
| 520° C.+ (vacuum residue) | 33.3 | 27.7 | 28.9 |
| RCT of the vacuum distillate, % w | 0.4 | 0.3 | 0.3 |
| RCT of the vacuum residue, % w | 15.4 | 8.8 | 13.6 |
| Deasphalting | | | |
| Temperature, °C. | 130 | 129 | 133 |
| Yield of deasphalted vacuum residue, pbw | 21.6 | 22.1 | 21.8 |
| Yield of asphaltic bitumen, pbw | 11.7 | 5.6 | 7.1 |
| RCT of the deasphalted vacuum residue, % w | 4.4 | 4.6 | 4.8 |
| Mixing | | | |
| Yield of mixture of vacuum distillate and deasphalted vacuum residue, pbw | 77.9 | 80.1 | 79.9 |
| Initial boiling point of the mixture, °C. | 370 | 370 | 370 |
| RCT of the mixture, % w | 1.5 | 1.5 | 1.5 |

As regards the question whether it is possible, in view of the maximum permissible value of G, starting from atmospheric residue B, to prepare by nothing but catalytic hydrotreatment a product from which, by distillation, an atmospheric residue can be obtained which has an initial boiling point of 370° C. and an RCT lower than that of atmospheric residue B, application of the relation found, in the form:

$$\frac{b-c}{b} \times 100 = F_{max},$$

with substitution of b=15.6, T=370 and d=29.4, shows that this is quite feasible provided that the atmospheric residue with an initial boiling point of 370° C. to be prepared has an RCT (c) higher than 4.7 %w.

If from atmospheric residue B an oil is to be prepared which has an initial boiling point of 370° C. and an RCT of 2.5 %w, a catalytic hydrotreatment alone is insufficient in view of the maximum permissible value of G. Then, in addition to the catalytic hydrotreatment a solvent deasphalting step should be applied. Application of the relation found, in the form:

maximum RCT reduction $=F_{max}$, and minimum RCT reduction $=F_{min}$ with substitution of b=15.6, T=370 and d-29.4, shows that for optimum utilization of the combination process care should be taken that the reduction in the catalytic hydrotreatment is between 60.0 and 70.0%.

With the object of preparing an oil having an initial boiling point of 370° C. and an RCT of 2.5 %w from atmospheric residue B, Experiment 18 was carried out. In this experiment atmospheric residue B was subjected to a catalytic hydrotreatment. The experiment was carried out in a 1000 ml reactor containing a fixed catalyst bed of the same composition as that used in Experiments 1–14. Experiment 18 was carried out at a temperature of 395° C., a pressure of 150 bar, a space velocity of 1.05 $g.g^{-1}.h^{-1}$ and a $H_2$/oil ratio of 1000 Nl/kg. The RCT reduction was 65%. The product of the catalytic hydrotreatment was separated by consecutive atmospheric distillation and vacuum distillation into a $C_4-$ fraction, a $H_2S+NH_3$ fraction, a $C_5$–370° C. atmospheric distillate, a 370°–520° C. vacuum distillate and a 520° C.+ vacuum residue. The vacuum residue was deasphalted with n-butane at a temperature of 115° C., a pressure of 40 bar and a solvent/oil weight ratio of 3:1, and the deasphalted vacuum residue obtained was mixed with the vacuum distillate. The results of this experiment according to the invention are given in Table C.

TABLE C

| | |
|---|---|
| Distillation | |
| Yield of products calculated on 100 pbw atmospheric residue I, pbw | |
| $C_4-$ | 0.98 |
| $H_2S + NH_3$ | 1.5 |
| $C_5$ –370° C. | 14.2 |
| 370–520° C. (vacuum distillate) | 48.3 |
| 520° C.+ (vacuum residue) | 32.6 |
| RCT of the vacuum distillate, % w | 0.5 |
| RCT of the vacuum residue, % w | 12.9 |
| Deasphalting | |
| Yield of deasphalted vacuum residue, pbw | 26.8 |
| Yield of asphaltic bitumen, pbw | 5.8 |
| RCT of the deasphalted vacuum residue, % w | 6.1 |
| Mixing | |
| Yield of mixture of vacuum distillate and deasphalted vacuum residue, pbw | 75.1 |
| Initial boiling point of the mixture, °C. | 370 |
| RCT of the mixture, % w | 2.5 |

What is claimed is:

1. A process for the preparation of a hydrocarbon mixture having an RCT of (a) %w and an initial boiling point of T°C., wherein an atmospheric residue I obtained in the distillation of a crude mineral oil, which atmospheric residue has an RCT of (b) %w and (d) %w of which boils below 520° C., is subjected to a catalytic hydrotreatment in order to reduce the RCT; the product obtained is separated by distillation into an atmospheric distillate and an atmospheric residue II having an initial boiling point of T°C.; either so much asphaltic bitumen is separated from the atmospheric residue II by solvent deasphalting that a deasphalted atmospheric residue having the desired RCT of (a) %w is obtained, or atmospheric residue II is separated by distillation into a vacuum distillate and a vacuum residue, from which vacuum residue so much asphaltic bitumen is separated by solvent deasphalting that a deasphalted vacuum residue is obtained which has such an RCT that, when it is mixed with the vacuum distillate, a mixture having the desired RCT of (a) %w is obtained; and the catalytic hydrotreatment is carried out under such conditions as to obey the relation:

$$RCT\text{ reduction} = \frac{b-c}{b} \times 100 =$$

$$\frac{51.6-0.526\times d-0.115-T+2.55\times b+0.00115\times T\times d}{(1.426-1.15\times 10^{-3}\times T)(1-0.01\times d)} \pm 5,$$

where (c) is the RCT of the atmospheric residue II having an initial boiling point T°C. of the hydrotreated product.

2. A process according to claim 1 wherein in the catalytic hydrotreatment for the reduction of the RCT a catalyst is used which contains at least one metal selected from the group consisting of nickel and cobalt and, in addition, at least one metal selected from the group consisting of molybdenum and tungsten on a carrier, which carrier consists more than 40 %w of alumina.

3. A process according to claim 2 wherein in the catalytic hydrotreatment for the reduction of the RCT a catalyst is used which comprises the metal combination nickel-molybdenum or cobalt-molybdenum on alumina as the carrier.

4. A process according to claim 1 wherein the catalytic hydrotreatment is carried out at a temperature of 300°-500° C., a pressure of 50-300 bar, a space velocity of 0.02-10 $g.g^{-1}.h^{-1}$ and a $H_2$/feed ratio of 100-5000 Nl/kg.

5. A process according to claim 4 wherein the catalytic hydrotreatment is carried out at a temperature of 350°-450° C., a pressure of 75-200 bar, a space velocity of 0.1-2 $g.g^{-1}.h^{-1}$ and a $H_2$/feed ratio of 500-2000 Nl/kg.

6. A process according to claim 1 wherein the solvent deasphalting is applied to the vacuum residue from the hydrotreated product.

7. A process according to claim 1 wherein the solvent deasphalting is carried out using n-butane as solvent at a pressure of 35-45 bar and a temperature of 100°-150° C.

8. A process for the preparation of a hydrocarbon mixture having an RCT of (a) %w and an initial boiling point of T°C., wherein an atmospheric residue I obtained in the distillation of a crude mineral oil, which atmospheric residue has an RTC of (b) %w and (d) %w of which boils below 520° C. and has a vanadium+-nickel content of more than 50 ppmw, is subjected to a catalytic hydrotreatment with two successive catalysts in order to reduce the RCT, the first catalyst being a demetallization catalyst comprising more than 80 %w of silica, and the second catalyst being an RCT reduction catalyst which contains at least one metal selected from the group consisting of nickel and cobalt and, in addition, at least one metal selected from the group consisting of molybdenum and tungsten on a carrier, which carrier comprises more than 40 %w of alumina; the product obtained is separated by distillation into an atmospheric distillate and an atmospheric residue II having an initial boiling point of T°C.; either so much asphaltic bitumen is separated from the atmospheric residue II by solvent deasphalting that a deasphalted atmospheric residue having the desired RCT of (a) %w is obtained, or atmospheric residue II is separated by distillation into a vacuum distillate and a vacuum residue, from which macuum residue so much asphaltic bitumen is separated by solvent deasphalting that a deasphalted vacuum residue is obtained which has such an RCT that, when it is mixed with the vacuum distillate, a mixture having the desired RCT of (a) %w is obtained; and the catalytic hydrotreatment is carried out under such conditions as to obey the relation:

$$RCT\text{ reduction} = \frac{b-c}{b} \times 100 = \frac{51.6 - 0.526 \times d - 0.115 \times T + 2.55 \times b + 0.00115 \times T \times d}{(1.426 - 1.15 \times 10^{-3} \times T)(1 - 0.01 \times d)} \pm 5$$

where (c) is the RCT of the atmospheric residue II having an initital boiling point T°C. of the hydrotreated product.

9. A process according to claim 8 wherein the demetallization catalyst comprises the metal combination nickel-vanadium on silica as the carrier, and the RCT reduction catalyst comprises the metal combination nickel-molybdenum or cobalt-molybdenum on alumina as the carrier.

* * * * *